US011646521B2

(12) United States Patent
Yonezu et al.

(10) Patent No.: US 11,646,521 B2
(45) Date of Patent: May 9, 2023

(54) CONNECTOR WITH TERMINAL FITTING

(71) Applicant: SUMITOMO WIRING SYSTEMS, LTD., Mie (JP)

(72) Inventors: Takuma Yonezu, Mie (JP); Hidekazu Matsuda, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/400,357

(22) Filed: Aug. 12, 2021

(65) Prior Publication Data

US 2022/0069505 A1 Mar. 3, 2022

(30) Foreign Application Priority Data

Aug. 26, 2020 (JP) ..... JP2020-142678

(51) Int. Cl.

*H01R 13/422* (2006.01)
*H01R 13/639* (2006.01)
*H01R 13/629* (2006.01)
*H01R 13/627* (2006.01)

(52) U.S. Cl.

CPC ..... *H01R 13/4223* (2013.01); *H01R 13/627* (2013.01); *H01R 13/629* (2013.01); *H01R 13/639* (2013.01)

(58) Field of Classification Search

CPC ..... H01R 13/4223; H01R 13/4226; H01R 13/627; H01R 13/629
USPC ..... 439/595
See application file for complete search history.

(56) References Cited

U.S. PATENT DOCUMENTS

| | | | | |
|---|---|---|---|---|
| 6,626,701 | B2 * | 9/2003 | Yoshida | H01R 13/4223 439/595 |
| 7,867,029 | B2 * | 1/2011 | Takahashi | H01R 13/4223 439/595 |
| 8,845,362 | B2 * | 9/2014 | Chikusa | H01R 13/6275 439/595 |
| 9,147,968 | B2 | 9/2015 | Nagasaka et al. | |
| 9,368,896 | B2 * | 6/2016 | Suzuki | H01R 13/4365 |
| 10,079,445 | B2 * | 9/2018 | Matsui | H01R 13/426 |
| 10,141,680 | B2 * | 11/2018 | Kitagawa | H01R 13/521 |
| 2004/0087209 | A1 * | 5/2004 | Nakamura | H01R 13/4364 439/595 |

(Continued)

*Primary Examiner* — Marcus E Harcum
(74) *Attorney, Agent, or Firm* — Venjuris, P.C.

(57) ABSTRACT

A connector includes a housing including a terminal accommodation chamber, a terminal fitting including a locking hole and to be inserted into the terminal accommodation chamber from behind the housing, and a locking lance for retaining the terminal fitting inserted into the terminal accommodation chamber. The locking lance is cantilevered forward and includes a body portion resiliently displaceable in a direction intersecting an insertion direction of the terminal fitting and a projection projecting from the body portion toward the terminal fitting and configured to enter the locking hole when the terminal fitting is inserted into the terminal accommodation chamber. A width of the projection is smaller than that of the locking hole. A maximum width of the body portion is larger than the width of the projection. A part of the body portion connected to the projection is formed with a guiding portion gradually reduced in width toward the projection.

6 Claims, 5 Drawing Sheets

(56) References Cited

U.S. PATENT DOCUMENTS

| | | | | |
|---|---|---|---|---|
| 2009/0124114 | A1* | 5/2009 | Ishikawa | H01R 13/4223 439/372 |
| 2009/0186512 | A1* | 7/2009 | Adachi | H01R 13/652 439/350 |
| 2010/0136819 | A1* | 6/2010 | Mase | H01R 13/743 439/345 |
| 2010/0273366 | A1* | 10/2010 | Okano | H01R 4/185 439/877 |
| 2011/0008989 | A1* | 1/2011 | Amano | H01R 13/6272 439/357 |
| 2011/0143588 | A1* | 6/2011 | Chikusa | H01R 13/4223 439/595 |
| 2012/0309219 | A1* | 12/2012 | Hiraishi | H01R 13/4223 439/352 |
| 2013/0288542 | A1* | 10/2013 | Zheng | H01R 13/4223 439/744 |
| 2014/0301780 | A1* | 10/2014 | Tanikawa | H01R 13/42 403/376 |
| 2019/0312373 | A1* | 10/2019 | Nakamura | H01R 13/4364 |

* cited by examiner

CONNECTOR WITH TERMINAL FITTING

CROSS-REFERENCE TO RELATED APPLICATIONS

This application is based on and claims priority from Japanese Patent Application No. 2020-142678, filed on Aug. 26, 2020, with the Japan Patent Office, the disclosure of which is incorporated herein in their entireties by reference.

TECHNICAL FIELD

The present disclosure relates to a connector.

BACKGROUND

Japanese Patent Laid-open Publication No. 2012-209221 discloses a connector including a first housing having a female terminal accommodation hole and a female connection terminal inserted into the female terminal accommodation hole. A female terminal locking lance including a projection is formed in the female terminal accommodation hole. The female connection terminal is formed with a lance engaging hole by being cut. The female connection terminal inserted into the female terminal accommodation hole is retained by locking the lance engaging hole to the projection of the female terminal locking lance.

SUMMARY

In the process of inserting the female connection terminal, the female terminal locking lance is resiliently displaced due to the interference of the female connection terminal with the projection. When the female connection terminal is inserted to a proper position, the female terminal locking lance resiliently returns and the projection enters the lance engaging hole. To smoothly insert the projection into the lance engaging hole, the female terminal locking lance is formed to be narrower than an opening width of the lance engaging hole. Thus, when the female connection terminal is pulled rearward and a front edge part of the lance engaging hole strongly comes into contact with a base end part of the projection, a shear stress concentrates on the base end part of the projection.

A connector of the present disclosure was completed on the basis of the above situation and it is aimed to reduce a shear stress generated in a locking lance when a terminal fitting is pulled.

The present disclosure is directed to a connector with a housing including a terminal accommodation chamber, a terminal fitting including a locking hole, the terminal fitting being inserted into the terminal accommodation chamber from behind the housing, and a locking lance for retaining the terminal fitting inserted into the terminal accommodation chamber, wherein the locking lance is cantilevered forward and includes a body portion resiliently displaceable in a direction intersecting an insertion direction of the terminal fitting and a projection projecting from the body portion toward the terminal fitting and configured to enter the locking hole when the terminal fitting is inserted into the terminal accommodation chamber, a width of the projection is smaller than that of the locking hole, a maximum width of the body portion is larger than the width of the projection, and a part of the body portion connected to the projection is formed with a guiding portion gradually reduced in width toward the projection.

According to the present disclosure, it is possible to reduce a shear stress generated in a locking lance when a terminal fitting is pulled.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
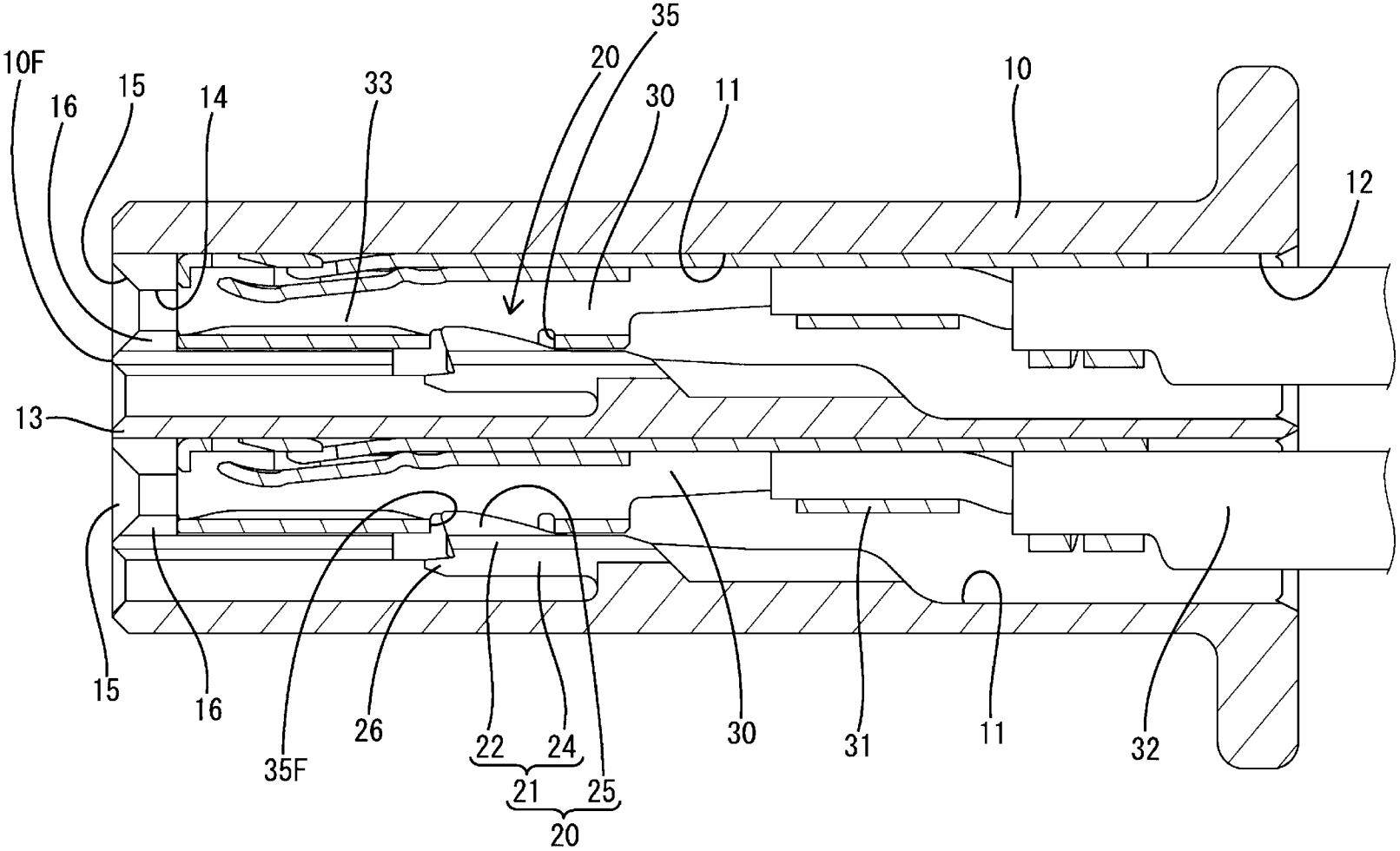
FIG. 1 is a side view in section of a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The connector of the present disclosure is provided with a housing including a terminal accommodation chamber, a terminal fitting including a locking hole, the terminal fitting being inserted into the terminal accommodation chamber from behind the housing, and a locking lance for retaining the terminal fitting inserted into the terminal accommodation chamber, wherein the locking lance is cantilevered forward and includes a body portion resiliently displaceable in a direction intersecting an insertion direction of the terminal fitting and a projection projecting from the body portion toward the terminal fitting and configured to enter the locking hole when the terminal fitting is inserted into the terminal accommodation chamber, a width of the projection is smaller than that of the locking hole, a maximum width of the body portion is larger than the width of the projection, and a part of the body portion connected to the projection is formed with a guiding portion gradually reduced in width toward the projection.

According to the configuration of the present disclosure, in the process of inserting the terminal fitting into the terminal accommodation chamber, the projection interferes with the terminal fitting to resiliently displace the locking lance in a direction away from the terminal fitting. When the terminal fitting is properly inserted, the projection enters the locking hole and is locked to the front edge of the locking hole as the locking lance resiliently returns, whereby the terminal fitting is retained. If the terminal fitting is strongly pulled rearward, the locking lance is displaced toward the terminal fitting and the body portion is accommodated into the locking hole while the front surface of the projection slides in contact with the front edge of the locking hole. Since the part of the body portion connected to the projection is formed with the guiding portion gradually reduced in width toward the projection, there is no possibility that the body portion is caught by the side edges of the locking hole. Since the front edge of the locking hole is locked to the body portion wider than the projection when the terminal fitting is pulled rearward, a shear stress generated in the locking lance is reduced as compared to the case where the front edge of the locking hole is locked to the projection.

(2) Preferably, the locking lance has an inclined surface facing forward of the locking lance and constituting the projection and the guiding portion, and the inclined surface is inclined in an overhanging manner so that the projection is located forward of the body portion. According to this configuration, since the front edge of the locking hole presses the inclined surface when the terminal fitting is pulled rearward, the locking lance is reliably displaced toward the terminal fitting by the inclination of the inclined surface. In this way, the body portion can be reliably brought into contact with the front edge of the locking hole.

(3) Preferably, in (2), a displacement restricting portion projecting further forward than the inclined surface and arranged opposite to the projection across the guiding portion is formed in a front end part of the locking lance. According to this configuration, a displacement of the locking lance toward the terminal fitting is stopped by the contact of the displacement restricting portion with the front edge of the locking hole when the terminal fitting is pulled rearward. In this way, the disengagement of the locking lance from the front edge of the locking hole can be prevented.

(4) Preferably, the terminal fitting includes a stabilizer extending from one side edge of an opening edge of the locking hole toward the locking lance, a pair of side surfaces constituting the guiding portion are constituted by a first slope facing the stabilizer and a second slope located opposite to the stabilizer across the guiding portion, and an angle formed by the first slope and the side surface of the projection is smaller than an angle formed by the second slope and the side surface of the projection. According to this configuration, since the angle formed by the second slope and the side surface of the projection is larger than the angle formed by the first slope and the side surface of the projection, the second slope is unlikely to be caught by the side edge of the locking hole in the process of inserting the body portion into the locking hole. Since the angle formed by the first slope and the side surface of the projection is smaller than the angle formed by the second slope and the side surface of the projection, a large width of the body portion can be ensured.

(5) Preferably, a front wall portion of the housing is formed with an insertion hole communicating with the terminal accommodation chamber from a front surface of the housing, a guiding surface formed by recessing the front surface of the housing in a tapered manner to surround the insertion hole, and a mold removal hole formed by cutting a region corresponding to at least the projection, out of the locking lance, in a front view. According to this configuration, since the mold removal hole corresponds to the projection having a small width, out of the locking lance, a large area of the guiding surface can be ensured as compared to the case where the mold removal hole formed in the guiding surface corresponds to only the wide body portion without corresponding to the projection.

DETAILS OF EMBODIMENT OF PRESENT DISCLOSURE

Embodiment

Figure 2:
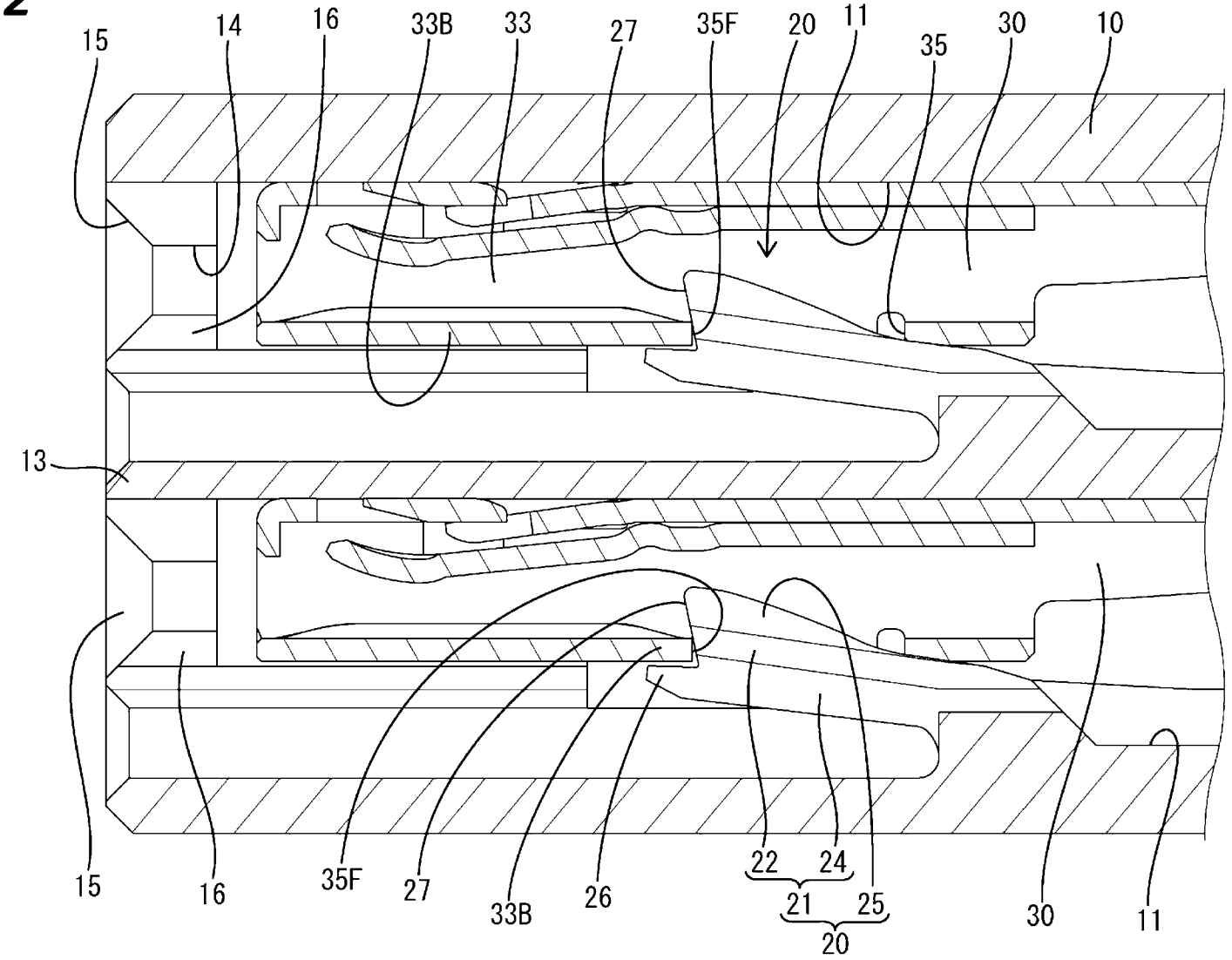
FIG. 2 is a partial enlarged side view in section showing a state where a terminal fitting is pulled rearward and a locking lance is displaced toward the terminal fitting.
Figure 3:
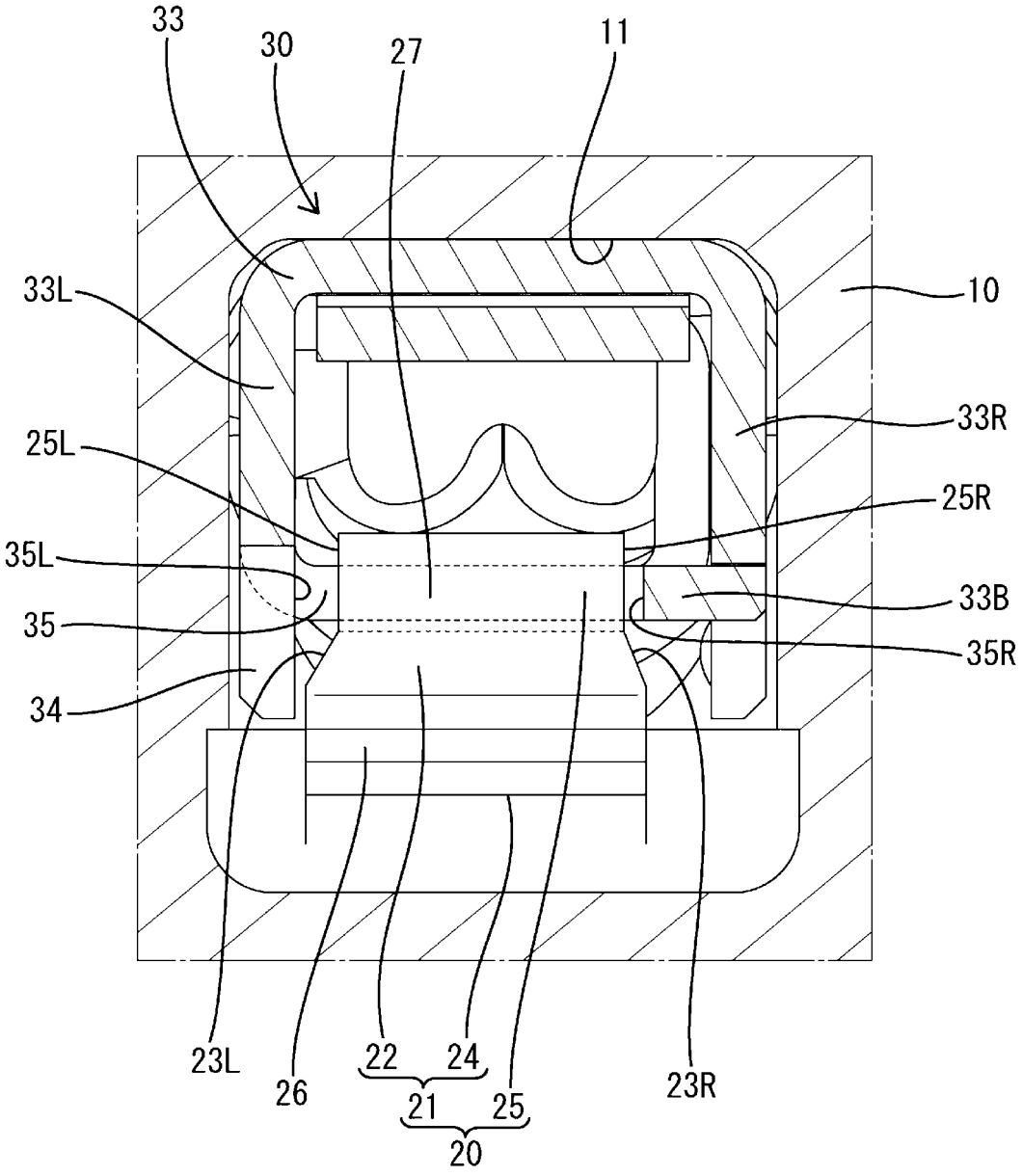
FIG. 3 is a partial enlarged front view in section of the connector.
Figure 4:
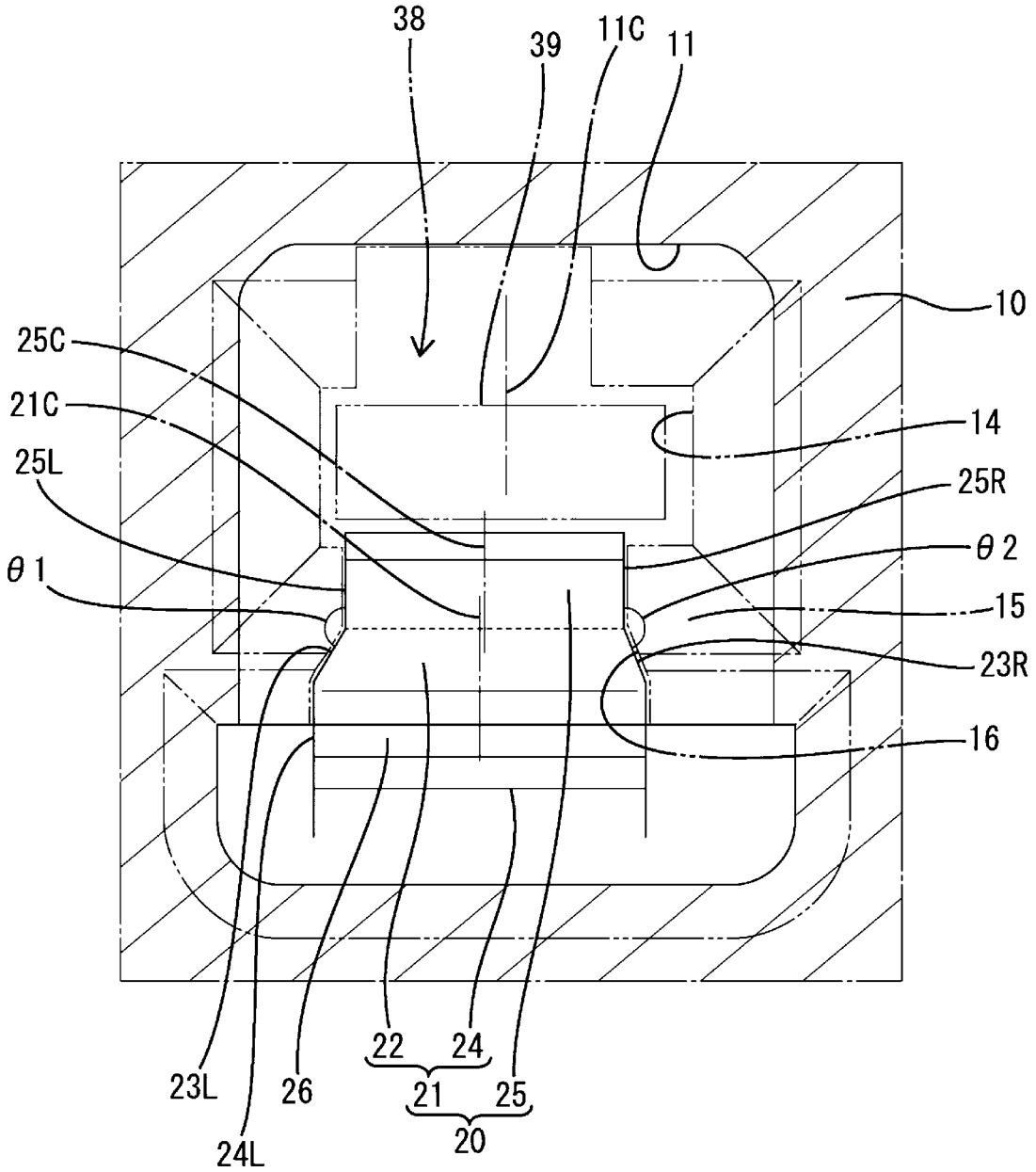
FIG. 4 is a partial enlarged front view in section of a housing showing a state where the terminal fitting is not inserted in a terminal accommodation chamber.

A specific embodiment of a connector of the present disclosure is described below with reference to FIGS. 1 to 5. Note that the present invention is not limited to these illustrations and is intended to be represented by claims and include all changes in the scope of claims and in the meaning and scope of equivalents. In this embodiment, a left side in FIGS. 1 and 2 is defined as a front side concerning a front-rear direction. Upper and lower sides shown in FIGS. 1 to 5 are directly defined as upper and lower sides concerning a vertical direction. Left and right sides shown in FIGS. 3 and 4 are directly defined as left and right sides concerning a lateral direction.

The connector of this embodiment includes a housing 10 made of synthetic resin and a plurality of terminal fittings 30 made of metal and fixed to front end parts of wires 32. As shown in FIGS. 1 to 3, a plurality of terminal accommodation chambers 11 are formed inside the housing 10. The rear end of the terminal accommodation chamber 11 is open as a terminal insertion opening 12 in the rear surface of the housing 10. A plurality of insertion holes 14 individually communicating with the respective terminal accommodation chambers 11 from a front surface 10F of the housing 10 are formed in a front wall portion of the housing 10. As shown in FIG. 4, in a front view of the housing 10, the insertion hole 14 has a rectangular opening. As shown in FIG. 4, a tab 39 of a mating terminal 38 is inserted into the insertion hole 14 from the front of the housing 10.

The front wall portion 13 is formed with guiding surfaces 15 by recessing rectangular regions surrounding the insertion holes 14 in the front surface 10F of the housing 10. The guiding surface 15 has a guiding function of guiding the tab 39 into the insertion hole 14 when the tab 39 is shifted from the insertion hole 14. As shown in FIGS. 1 and 2, the front wall portion 13 is formed with mold removal holes 16 penetrating into the terminal accommodation chambers 11 from the front surface 10F of the housing 10. The mold removal holes 16 are spaces formed in the process of molding locking lances 20 to be described later.

As shown in FIGS. 1 and 2, the locking lance 20 for retaining and holding the terminal fitting 30 inserted to a proper position in the terminal accommodation chamber 11 is formed in the terminal accommodation chamber 11. The locking lance 20 includes a body portion 21 cantilevered forward along the lower surface of the terminal accommodation chamber 11, a projection 25 projecting upward from the body portion 21 and a displacement restricting portion 26 projecting forward from the body portion 21. The body portion 21 of the locking lance 20 can be resiliently deformed with a rear end part (base end part) of the body portion 21 as a fulcrum while the posture thereof is inclined in the vertical direction.

Figure 5:
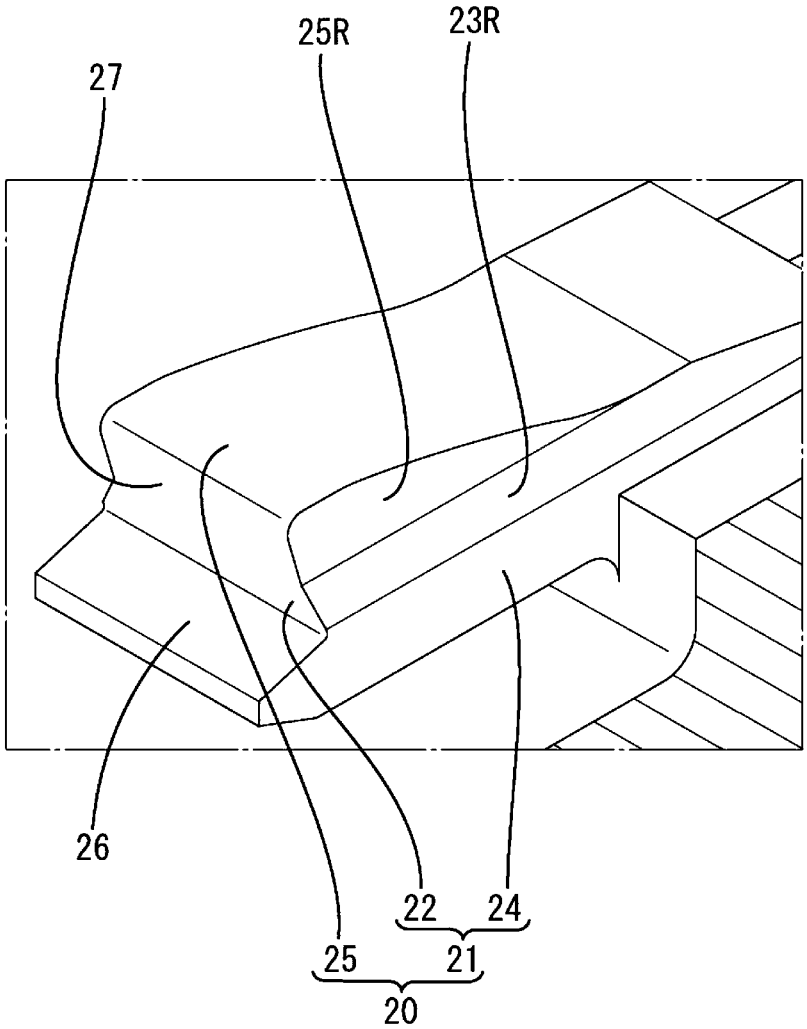
FIG. 5 is a perspective view of the locking lance.

As shown in FIGS. 3 to 5, a guiding portion 22 gradually reduced in width toward an upper side is formed in an upper end part of the body portion 21. As shown in FIGS. 3 and 4, the guiding portion 22 has a bilaterally asymmetrical trapezoidal shape in a front view. A left side surface in the front view of the guiding portion 22 serves as a first slope 23L. A right side surface in the front view of the guiding portion 22 serves as a second slope 23R. A part of the body portion 21 below the guiding portion 22 serves as a wide portion 24 having a constant width. A width of the wide portion 24 is equal to a maximum width of the body portion 21 and a maximum width of the guiding portion 22.

The projection 25 projects from the body portion 21 in a direction toward the terminal fitting 30 in the terminal accommodation chamber 11. A formation range of the projection 25 in the front-rear direction is an entire region from the front end to a rear end part of the body portion 21. The upper surface of the projection 25 is inclined to become gradually lower toward a rear side. As shown in FIGS. 3 and 4, a lateral width of the projection 25 is smaller than the maximum width of the body portion 21 and equal to a minimum width of the guiding portion 22.

As shown in FIG. 4, the left side surface 25L of the projection 25 and the first slope 23L are connected at an obtuse angle θ1. The right side surface 25R of the projection 25 and the second slope 23R are connected at an obtuse angle θ2. The angle θ1 formed by the left side surface 25L of the projection 25 and the first slope 23L is smaller than the angle θ2 formed by the right side surface 25R of the projection 25 and the second slope 23R. In a front view, a lateral center of the projection 25 is shifted rightward with respect to a lateral center 21C of the body portion 21 (wide portion 24). Further, the entire locking lance 20 (center 21C of the body portion 21) is arranged at a position shifted leftward with respect to a lateral center 11C of the terminal accommodation chamber 11.

As shown in FIGS. 1, 2 and 5, the displacement restricting portion 26 projects forward from the front end of the wide portion 24, out of the body portion 21. As shown in FIGS. 2 and 5, a region of the front surface of the locking lance 20 above the displacement restricting portion 26 serves as an inclined surface 27, which is a flat surface slightly inclined in an overhanging manner with respect to a forward projecting direction of the locking lance 20. The inclined surface 27 constitutes the front surface of the guiding portion 22 and the front surface of the projection 25.

As shown in FIG. 4, the mold removal hole 16 formed in the front wall portion 13 of the housing 10 is formed by partially cutting the guiding surface 15 in a front view. A region of the mold removal hole 16 cutting the guiding surface 15 is a space corresponding to the projection 25 and the guiding portion 22 of the locking lance 20. A space of the mold removal hole 16 corresponding to the wide portion 24 is disposed below the guiding surface 15. Since the projection 25 has a smaller width than the wide portion 24, an area of the guiding surface 15 lost by forming the mold removal hole 16 is smaller as compared to the case where the wide portion 24 corresponds to the guiding surface 15.

The terminal fitting 30 is formed into a shape elongated in the front-rear direction as a whole, such as by applying bending and the like to a metal plate material. As shown in FIG. 1, a crimping portion 31 in a rear end part of the terminal fitting 30 is crimped to the wire 32. A rectangular tube portion 33 is formed in a front end part of the terminal fitting 30. As shown in FIG. 3, the rectangular tube portion 33 is formed with a stabilizer 34 flush with the left side plate portion 33L by extending a left side plate portion 33L of the rectangular tube portion 33 downward.

As shown in FIGS. 1 to 3, the rectangular tube portion 33 is formed with a locking hole 35 open in the lower surface of the rectangular tube portion 33. As shown in FIG. 3, since the locking lance 20 is shifted leftward with respect to the terminal accommodation chamber 11 in a front view, the locking hole 35 is also shifted leftward with respect to the terminal accommodation chamber 11 and the terminal fitting 30 (rectangular tube portion 33). An opening range of the locking hole 35 in the lateral direction is a range from the inner surface of the left side plate portion 33L of the rectangular tube portion 33 to a position to the left of the inner surface of a right side plate portion 33R of the rectangular tube portion 33. The locking hole 35 is formed by cutting a region of a lower plate portion 33B of the rectangular tube portion 33 except a right end part. A left side edge 35L, out of the opening edge of the locking hole 35, is constituted by the inner surface of the stabilizer 34. The right side edge 35R, out of the opening edge of the locking hole 35, is constituted by the lower plate portion 33B. A lateral width of the locking hole 35 is larger than the width of the projection 25 of the locking lance 20.

Next, the process of inserting the terminal fitting 30 into the housing 10 is described. In the process of inserting the terminal fitting 30 into the terminal accommodation chamber 11, the lower plate portion 33B of the rectangular tube portion 33 interferes with the projection 25, whereby the locking lance 20 is resiliently displaced downward away from the terminal fitting 30. When the terminal fitting 30 is inserted to a proper position, the locking lance 20 resiliently returns and, as shown in FIG. 1, the projection 25 enters the locking hole 35. Since the width of the projection 25 is smaller than that of the locking hole 35, the projection 25 does not interfere with the opening edge of the locking hole 35.

When the projection 25 enters the locking hole 35, the front surface (inclined surface 27) of the projection 25 proximately faces a front edge 35F of the locking hole 35. A part of the inclined surface 27 constituting the guiding portion 22 is located below the rectangular tube portion 33, i.e. outside the locking hole 35. Since the front edge 35F of the locking hole 35 proximately faces the inclined surface 27 from front, the terminal fitting 30 is held retained by the front edge 35F of the locking hole 35 butting against the inclined surface 27 of the locking lance 20 for locking even if the terminal fitting 30 is pulled rearward.

If the terminal fitting 30 is strongly pulled rearward, the front edge 35F of the locking hole 35 strongly presses the overhanging inclined surface 27. Thus, the locking lance 20 is resiliently displaced upward by the inclination of the inclined surface 27. As shown in FIG. 2, the guiding portion 22 enters the locking hole 35 according to a resilient displacement of the locking lance 20. At this time, there is a concern for the interference of the second slope 23R with a right side edge 35R of the locking hole 35. However, as shown in FIG. 4, an angle of inclination of the second slope 23R with respect to a resilient displacement direction of the locking lance 20 is made small by setting the angle θ2 formed by the right side surface 25R of the projection 25 and the second slope 23R to be large. In this way, the second slope 23R slides in contact with the right side edge 35R of the locking hole 35 without being caught even if the second slope 23R contacts the right side edge 35R. Therefore, the second slope 23R does not interfere with the right side edge 35R of the locking hole 35.

On the other hand, for the first slope 23L, the angle θ1 to the left side surface 25L of the projection 25 is set to be smaller than the angle θ2 formed by the second slope 23R and the right side surface 25R of the projection 25. By this angle setting, the left side surface 24L of the body portion 21 (wide portion 24) largely protrudes leftward with respect to the left side surface 25L of the projection 25. Thus, an increase in the width of the body portion 21 is realized. If the angle θ1 formed by the left side surface 25L of the projection 25 and the first slope 23L is made small, the angle of inclination of the first slope 23L with respect to the resilient displacement direction of the locking lance 20 becomes large. Thus, there is a concern for the interference of the first slope 23L with the left side edge 35L of the locking hole 35. However, since the stabilizer 34 of the terminal fitting 30 constituting the left side edge 35L of the locking hole 35 extends up to a position below the first slope 23L of the locking lance 20, the first slope 23L does not interfere with the left side edge 35L of the locking hole 35.

If the terminal fitting 30 is strongly pulled rearward, the guiding portion 22 enters the locking hole 35 until the displacement restricting portion 26 butts against the lower surface of the lower plate portion 33B of the rectangular tube portion 33 and the front edge 35F of the locking hole 35 strongly presses the front surface (inclined surface 27) of the guiding portion 22 as shown in FIG. 2. By this pressing, a shear stress acting in the front-rear direction with the front edge 35F of the locking hole 35 as a boundary is generated in the locking lance 20. A position where the shear stress is generated is not in the projection 25, but in the guiding portion 22 wider than the projection 25, i.e. a lower end part of the guiding portion 22 having a largest width. Since a shear force exerted to the locking lance 20 from the front edge 35F of the locking hole 35 is more dispersed in the lateral direction as the width becomes larger, the shear stress generated in the locking lance 20 is suppressed to be small as compared to the case where the shear force is exerted to the projection 25 having a smaller width than the body portion 21. Therefore, the shear fracture of the locking lance 20 is prevented.

The connector of this embodiment includes the housing 10 having the terminal accommodation chambers 11, the terminal fittings 30 to be inserted into the terminal accommodation chambers 11 from behind the housing 10, and the locking lances 20 for retaining the terminal fittings 30 inserted into the terminal accommodation chambers 11. The locking lance 20 includes the body portion 21 and the projection 25. The body portion 21 is cantilevered forward and resiliently displaceable in the vertical direction intersecting an insertion direction of the terminal fitting 30. The projection 25 projects from the body portion 21 toward the terminal fitting 30, and enters the locking hole 35 of the terminal fitting 30 when the terminal fitting 30 is inserted into the terminal accommodation chamber 11. The width of the projection 25 is smaller than that of the locking hole 35. The maximum width of the body portion 21 is larger than the width of the projection 25. The part (upper end part) of the body portion 21 connected to the projection 25 is formed with the guiding portion 22 gradually reduced in width toward the projection 25.

According to this configuration, in the process of inserting the terminal fitting 30 into the terminal accommodation chamber 11, the projection 25 interferes with the terminal fitting 30 to resiliently displace the locking lance 20 in the direction away from the terminal fitting 30. When the terminal fitting 30 is properly inserted, the projection 25 enters the locking hole 35 and is locked to the front edge 35F of the locking hole 35 as the locking lance 20 resiliently returns, whereby the terminal fitting 30 is retained. If the terminal fitting 30 is strongly pulled rearward, the locking lance 20 is displaced toward the terminal fitting 30 and the upper end part of the body portion 21 is accommodated into the locking hole 35 while the front surface (inclined surface 27) of the projection 25 slides in contact with the front edge 35F of the locking hole 35.

Since the part of the body portion 21 connected to the projection 25 is formed with the guiding portion 22 gradually reduced in width toward the projection 25, there is no possibility that the body portion 21 is caught by the left side edge 35L and the right side edge 35R of the locking hole 35. Since the front edge 35F of the locking hole 35 is locked to the body portion 21 (guiding portion 22) wider than the projection 25 when the terminal fitting 30 is pulled rearward, a shear stress generated in the locking lance 20 is reduced as compared to the case where the front edge 35F of the locking hole 35 is locked to the projection 25.

The locking lance 20 has the inclined surface 27 facing forward of the locking lance 20. The inclined surface 27 constitutes the projection 25 and the guiding portion 22 and is inclined in an overhanging manner so that the projection 25 is located forward of the body portion 21. Since the front edge 35F of the locking hole 35 presses the inclined surface 27 when the terminal fitting 30 is pulled rearward, the locking lance 20 is reliably displaced toward the terminal fitting 30 by the inclination of the inclined surface 27. In this way, the body portion 21 can be reliably brought into contact with the front edge 35F of the locking hole 35.

A front end part of the locking lance 20 is formed with the displacement restricting portion 26. The displacement restricting portion 26 projects further forward than the inclined surface 27, and is arranged vertically opposite to the projection 25 across the guiding portion 22. By forming the displacement restricting portion 26, a displacement of the locking lance 20 toward the terminal fitting 30 is stopped by the contact of the displacement restricting portion 26 with the front edge 35F of the locking hole 35 when the terminal fitting 30 is pulled rearward. In this way, the disengagement of the locking lance 20 from the front edge 35F of the locking hole 35 can be prevented.

The terminal fitting 30 includes the stabilizer 34 extending toward the locking lance 20 from one side edge (left side edge 35L), out of the opening edge of the locking hole 35. A pair of left and right side surfaces constituting the guiding portion 22 are constituted by the first slope 23L facing the stabilizer 34 and the second slope 23R located opposite to the stabilizer 34 across the guiding portion 22. The angle θ1 formed by the first slope 23L and the left side surface 25L of the projection 25 is smaller than the angle θ2 formed by the second slope 23R and the right side surface 25R of the projection 25. Since the first slope 23L is facing the stabilizer 34, the first slope 23L does not interfere with the left side edge 35L of the locking hole 35 when the terminal fitting 30 is strongly pulled rearward and the body portion 21 enters the locking hole 35. Since the angle θ2 formed by the second slope 23R and the right side surface 25R of the projection 25 is larger than the angle θ1 formed by the first slope 23L and the left side surface 25L of the projection 25, the second slope 23R is unlikely to be caught by the right side edge 35R of the locking hole 35 in the process of inserting the body portion 21 into the locking hole 35.

The front wall portion 13 of the housing 10 is formed with the insertion holes 14, the guiding surfaces 15 and the mold removal holes 16. The insertion holes 14 communicate with the terminal accommodation chambers 11 from the front surface 10F of the housing 10. The guiding surfaces 15 are formed by recessing the front surface 10F of the housing 10 in a tapered manner to surround the insertion holes 14. The mold removal hole 16 is formed by cutting the region corresponding to at least the projection 25 of the locking lance 20 in a front view. If the region of the mold removal hole 16 cutting the guiding surface 15 corresponds to only the wide body portion 21 rather than corresponding to the projection 25, the area of the guiding surface 15 becomes small. In contrast, the mold removal hole 16 of this embodiment corresponds to only the projection 25 narrower than the wide portion 24 and the guiding portion 22 of the body portion 21 reduced in width toward the projection 25 without corresponding to the wide portion 24 of the body portion 21 of the locking lance 20. In this way, the range of the guiding surface 15 cut by the mold removal hole 16 becomes smaller, wherefore the area of the guiding surface 15 becomes wider and a wide range where the tab 39 can be guided by the guiding surface 15 can be ensured.

Other Embodiments

The present invention is not limited to the above described and illustrated embodiment and is represented by claims. The present invention is intended to include all changes in the scope of claims and in the meaning and scope of equivalents and include also embodiments described below.

Although only the guiding portion is formed with the inclined surface, out of the body portion, in the above embodiment, a formation range of the inclined surface may extend to a region of the body portion other than the guiding portion.

Although the locking lance has the overhanging inclined surface in the above embodiment, the locking lance may not have the overhanging inclined surface.

Although the pair of side surfaces constituting the guiding portion are constituted by the first and second slopes having different angles of inclination in the above embodiment, the pair of side surfaces constituting the guiding portion may be bilaterally symmetrically shaped.

Although the mold removal hole corresponds to the projection and the guiding portion of the locking lance in the above embodiment, the mold removal hole may be shaped to correspond to only the projection or shaped to correspond to only the guiding portion.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing including a terminal accommodation chamber;

a terminal fitting including a locking hole, the terminal fitting being inserted into the terminal accommodation chamber from behind the housing; and a locking lance for retaining the terminal fitting inserted into the terminal accommodation chamber, wherein:

the locking lance is cantilevered forward and includes a body portion resiliently displaceable in a direction intersecting an insertion direction of the terminal fitting and a projection projecting from the body portion toward the terminal fitting and configured to enter the locking hole when the terminal fitting is inserted into the terminal accommodation chamber, a width of the projection is smaller than that of the locking hole, a maximum width of the body portion is larger than the width of the projection, a part of the body portion connected to the projection is formed with a guiding portion gradually reduced in width toward the projection, the locking lance has an inclined surface facing forward of the locking lance and constituting a front surface of the projection and a front surface of the guiding portion, and the inclined surface is inclined in an overhanging manner so that the projection is located forward of the body portion.

2. The connector of claim 1, wherein a displacement restricting portion projecting further forward than the inclined surface and arranged opposite to the projection across the guiding portion is formed in a front end part of the locking lance.

3. The connector of claim 1, wherein:

the terminal fitting includes a stabilizer extending from one side edge of an opening edge of the locking hole toward the locking lance, a pair of side surfaces constituting the guiding portion are constituted by a first slope facing the stabilizer and a second slope located opposite to the stabilizer across the guiding portion, and an angle formed by the first slope and one side surface of the projection is smaller than an angle formed by the second slope and another side surface of the projection.

4. The connector of claim 1, wherein a front wall portion of the housing is formed with:

an insertion hole communicating with the terminal accommodation chamber from a front surface of the housing;

a guiding surface formed by recessing the front surface of the housing in a tapered manner to surround the insertion hole; and a mold removal hole formed by cutting a region corresponding to at least the projection, out of the locking lance, in a front view.

5. The connector of claim 2, wherein a displacement of the locking lance toward the terminal fitting is stopped by contact of the displacement restricting portion with a front edge of the locking hole when the terminal fitting is pulled rearward.

6. The connector of claim 1, wherein the guiding portion has a bilaterally asymmetrical trapezoidal shape in a front view.

* * * * *